US006267318B1

(12) United States Patent
Gensheimer

(10) Patent No.: US 6,267,318 B1
(45) Date of Patent: Jul. 31, 2001

(54) DIFFERENTIAL WINDING RATE CORE WINDING APPARATUS

(75) Inventor: Robert Peter Gensheimer, Sparta, NJ (US)

(73) Assignee: Convertech, Inc., Wharton, NJ (US)

( * ) Notice: Subject to any disclaimer, the term of this patent is extended or adjusted under 35 U.S.C. 154(b) by 0 days.

(21) Appl. No.: 09/385,283

(22) Filed: Aug. 30, 1999

(51) Int. Cl.[7] ..... B65H 18/08

(52) U.S. Cl. ..... 242/530.3; 242/571.2; 242/576.1

(58) Field of Search ..... 242/530.3, 576.1, 242/571.1, 571.2

(56) References Cited

U.S. PATENT DOCUMENTS

| | | | | |
|---|---|---|---|---|
| 2,215,069 | | 9/1940 | Meisel . | |
| 2,849,192 | | 8/1958 | Fairchild . | |
| 3,006,152 | | 10/1961 | Rusche . | |
| 3,053,467 | | 9/1962 | Gidge . | |
| 3,127,124 | | 3/1964 | Tidland et al. . | |
| 3,310,252 | | 3/1967 | Ewing . | |
| 3,391,878 | * | 7/1968 | Naccara | 242/571.1 |
| 4,026,488 | | 5/1977 | Hashimoto . | |
| 4,209,138 | * | 6/1980 | Cecchi | 242/530.3 |
| 4,220,291 | | 9/1980 | Papa . | |
| 4,332,356 | | 6/1982 | Damour . | |
| 4,693,431 | * | 9/1987 | Kataoka | 242/530.3 X |
| 4,840,323 | * | 6/1989 | Nakajima | 242/571.2 |
| 4,953,877 | | 9/1990 | Slachta et al. . | |
| 5,137,224 | * | 8/1992 | Peters et al. | 242/530.3 |
| 5,279,470 | * | 1/1994 | Birkmann et al. | 242/530.3 |
| 5,375,791 | * | 12/1994 | Kline et al. | 242/576.1 X |
| 5,478,025 | * | 12/1995 | Wang | 242/530.3 X |
| 5,518,203 | * | 5/1996 | Annaka et al. | 242/576.1 |
| 5,797,559 | * | 8/1998 | Coffey . | |
| 5,971,314 | * | 10/1999 | Essert | 242/530.3 |

FOREIGN PATENT DOCUMENTS

| | | | | |
|---|---|---|---|---|
| 3523464 | * | 1/1987 | (DE) | 242/576.1 |
| 4009849 | * | 7/1991 | (DE) | 242/530.3 |
| 2021653 | * | 1/1987 | (JP) | 242/530.3 |

* cited by examiner

*Primary Examiner*—William A. Rivera
(74) *Attorney, Agent, or Firm*—Carella Byrne Bain Gilfillan; John G. Gilfillan, II; William Squire

(57) ABSTRACT

A plurality of core mounting ring members are rotationally slidably mounted on a drive shaft which has a central axial bore for receiving settable pressurized air. The ring members have an annular array of bores with core gripping buttons resiliently urged radially outwardly to grip a core receiving a winding strip thereabout. A central groove on an inner surface of each of the ring member is fluid coupled to the gripping button bores and to the drive shaft central bore for urging the buttons outwardly with pressurized air. The button bores are fluid coupled to two annular grooves on each side of the central ring member groove. A chlorinated quad O-ring is in each of the two annular grooves. Regulated pressurized air from the central groove flows through the button bores into the O-ring grooves urging the O-rings radially inwardly to both fluid seal the central groove and to provide a settable friction engagement with the drive shaft to settably control the speed and torque of the mounting ring members to provide a more uniform tension on the strips being wound.

21 Claims, 2 Drawing Sheets

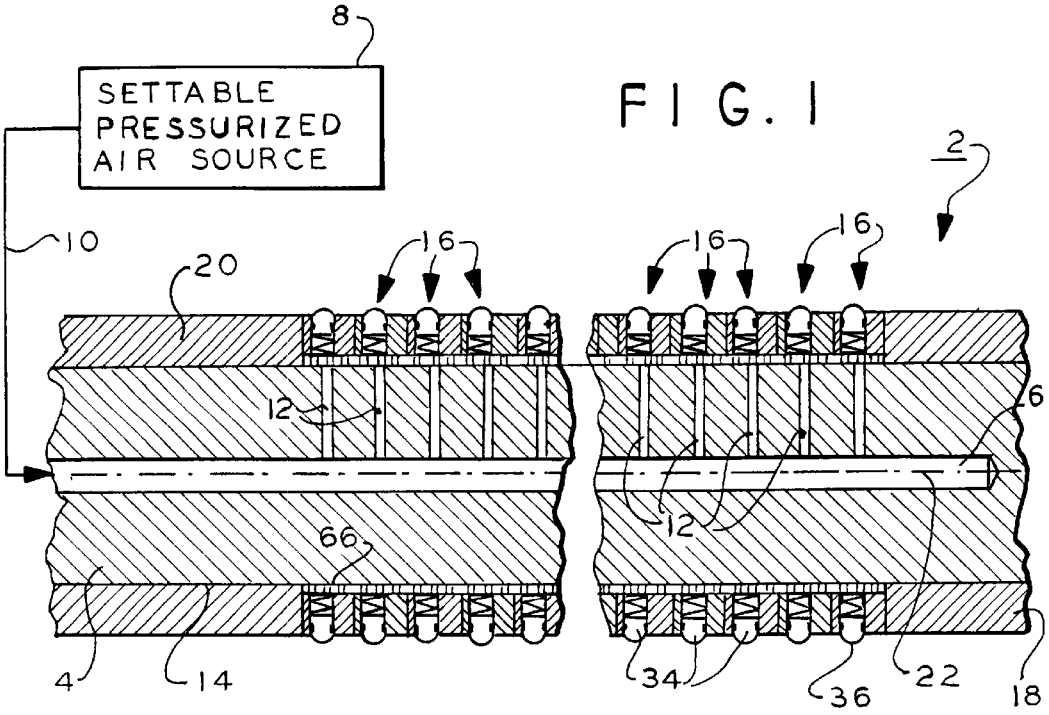
FIG. 1
FIG. 2
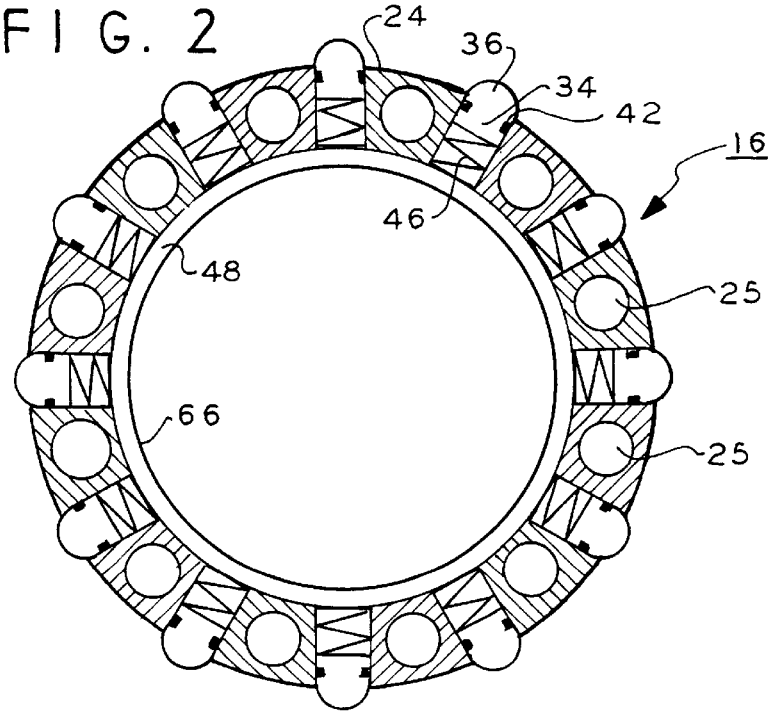

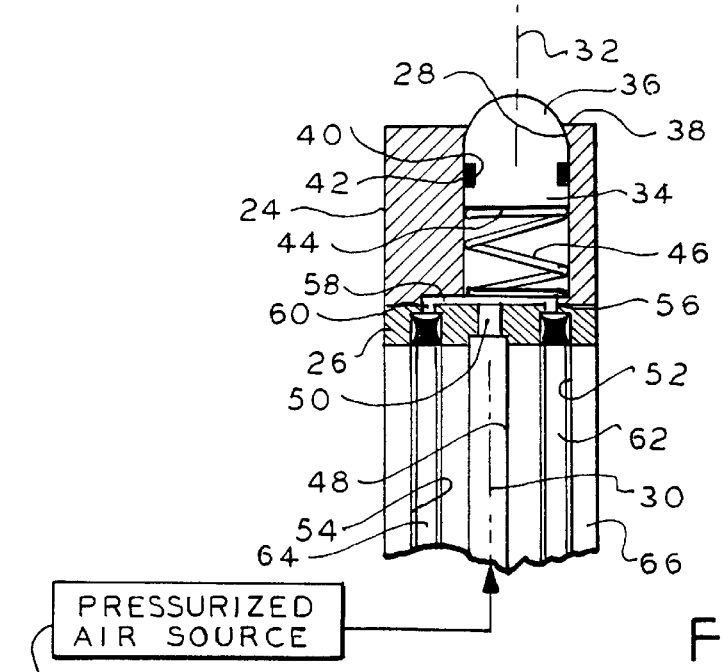
FIG. 3
FIG. 4
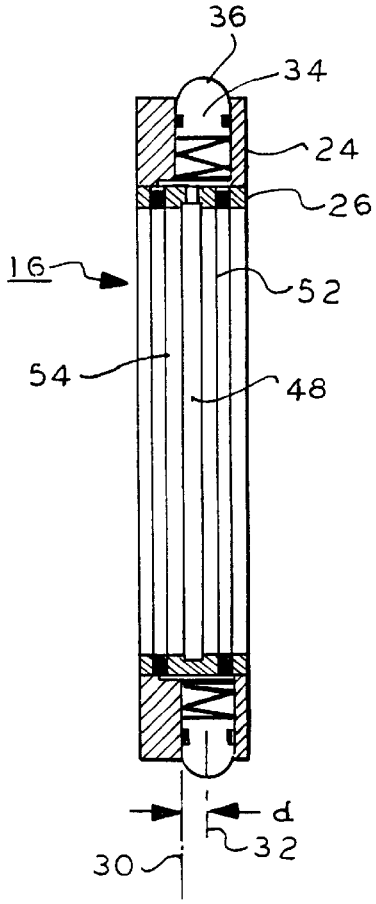
FIG. 5
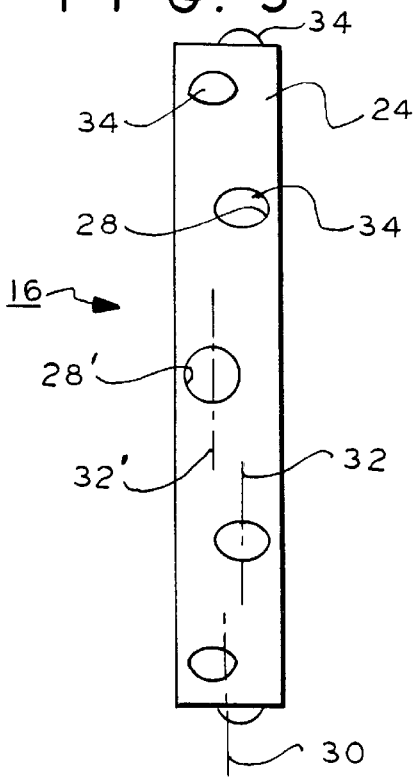

DIFFERENTIAL WINDING RATE CORE WINDING APPARATUS

This invention relates to winding apparatus for winding tapes, cords and so on onto cores mounted on a drive shaft.

Typically elongated members such as paper, tape, cord and the like are wound on paperboard, plastic or other material cylindrical ring cores. These cores are mounted on a common drive shaft. As a result, problems arise when the winding tension of the elongated members on the different cores varies. If the tension is too low, the elongated members may be wound too loosely. If the tension gets too high, the elongated member may break. Either condition is not acceptable on a high speed mass production apparatus.

In U.S. Pat. No. 4,026,488 to Hashimoto, for example, cylindrical winding cores are mounted on a plurality core holders and a plurality of friction collars are mounted alternately on a single hollow shaft under axial pressure. Each of the collars is allowed to e axially moved and constrained in rotation and each of the core holders has a radial expansible means which are radially expanded by an air pressure supplied to a hollow shaft to come into pressure engagement with the inner surfaces of the cylindrical winding cores on the core holders. Catch buttons are used with a leaf spring to return the catch button to its retracted position when pressure is lost. When pressure is applied to a pressure chamber, the leaf spring and expansible means cooperate to push the catch buttons outwardly to grip a core. The expansible means is a radially expansible elastic half tube and responsive to pneumatic pressure applied to a pressure chamber. Pressure is applied axially to couple the T-shaped collars for rotation which pressure is changed to change the magnitude of the axial pressure applied from a shaft end. This is a relatively complex and costly apparatus.

In U.S. Pat. No. 2,215,069, spindles are disclosed for rolls to be wound on cores with a uniform grip. Disclosed plugs may be thrust outwardly into engagement with a core by means of a pressurized air inflatable tube encircling an inner shell and bound thereto by bands. When the tube is inflated the plugs are pressed outwardly and apply a pressure against the core inner wall to provide a compact winding and uniform tension.

U.S. Pat. No. 2,849,192 to Fairchild discloses a core engaging shaft. Fluid pressure is applied to a diaphragm and bulge it outwardly to grip a core.

U.S. Pat. No. 3,006,152 to Rusche discloses a pile driving mandrel.

U.S. Pat. No. 3,053,467 to Gidge discloses an expansible shaft employing fluid pressure. Self retractable gripping elastomeric members are mounted along an inner face of an outer shell, each with a radially extending portion. The shell is rigid and perforated with radial passages each receiving a member radial portion. Pressure deforms the members radially outwardly in the passages and project beyond the shell to increase the overall diameter of the shell. An inner inflatable container forms an elongated chamber with the inner face of the shell. The container is inflated to distort the buttons and cause the buttons to extend from the shell.

U.S. Pat. Nos. 3,127,124, 4,220,291, 4,332,356 and 4,953,877 disclose chucks and apparatus related to winding tape and similar products on cores. Many of the above patents relate generally to providing plugs which radially extend outwardly for gripping a core. The problem as recognized by the present inventor with these apparatuses is that while the plugs are intended to provide uniform tension on the strips, tapes and so on being wound by gripping the cores with the plugs, there is still present a problem of lack of uniform tension on the strips and so on in many instances. Such lack of uniform tension may result in breakage or loose windings as discussed above.

Apparatus for securing a plurality of cylindrical winding cores on a winding drive shaft during winding of elongated elements at differential winding rates on a corresponding core according to the present invention comprises a hollow cylindrical mounting ring member defining a rotation axis and for releasably mounting a first core thereon and adapted to be rotationally slidably secured on a received drive shaft at a mounting member drive shaft interface surface, the mounting member having a plurality of bores extending radially relative to the axis. A button radially movable is in each of the bores. Means are included for radially outwardly displacing the button in each of the bores for gripping the first core mounted thereon. A gripping element is at the interface surface and responsive to applied forces to cause the gripping element to frictionally couple the mounting member to the drive shaft such that the mounting member is rotatably driven by the drive shaft at a speed or torque corresponding to the magnitude of the friction value.

In one aspect, the cylindrical core mounting member has a first annular groove in the interface surface, the gripping element comprising a first resilient pliable material in the first groove and which element in response to the applied forces grips and couples the drive shaft to the mounting member while simultaneously sealing the interface between the mounting ring member and the drive shaft.

In a further aspect, fluid passage means are in the mounting member for receiving applied pressurized fluid and for applying the received pressurized fluid to the bores for radial outward displacement of the corresponding buttons and for applying the pressurized fluid to the first gripping element for applying radial inward forces to the element for friction and sealing engagement with the drive shaft.

In a further aspect, the fluid passage means comprises a second annular groove in the interface surface and at least one aperture in the mounting member and in fluid communication with and corresponding to each bore and the second annular groove, the second groove for fluid coupling the bores to a source of the pressurized fluid through the at least one aperture.

In a further aspect, a third annular groove is in the mounting member interface surface in fluid communication with the at least one aperture for receiving the applied pressurized fluid, the third groove including a second resilient pliable gripping element which is responsive to pressurized fluid created forces thereon for gripping and coupling he drive shaft to the mounting member.

In a further aspect, the gripping element comprises an elastomeric ring.

The gripping element preferably is adapted to frictionally engage the mounting element and drive shaft at corresponding settable friction values, the values of the friction corresponding to the pressure value of the pressurized fluid.

The friction coupling of the mounting member to the drive shaft is preferably such that there is rotational slippage between the mounting member and drive shaft.

In a further aspect, the fluid passage means comprises further passages fluid coupling each of the bores to the first and third grooves.

In a further aspect, there are passages so positioned and responsive to an applied pressurized fluid to create the applied forces so that the gripping elements are forced radially inwardly toward the received drive shaft.

Means are provided in a further aspect for setting the value of the applied forces.

As a result, the drive shaft is coupled to each mounting member for independent rotation of each mounting member with a settable coupling friction force and thus each core by a frictional engagement. The tensile load on a given core determines the degree of slippage between the drive shaft and the mounting member for that core. Thus, when the tension varies among the different cores, the slidable friction engagement with the drive shaft between the different mounting members provides differential slippage for the higher tension cores permitting slippage and providing more uniform tension. For more loosely wound cores, the additional frictional engagement of the drive shaft to the core provides a driving torque on that core relative to the other cores for increasing the winding tension thereon.

IN THE DRAWING

FIG. 1 is a sectional elevation view through a drive shaft and core mounting ring member assembly according to one embodiment of the present invention;

FIG. 2 is a sectional side elevation view through a core mounting ring member of embodiment of FIG. 1 without the drive shaft;

FIG. 3 is a more detailed view of the core mounting ring member of the embodiment of FIG. 1 without the drive shaft;

FIG. 4 is a sectional elevation view of the mounting ring member; and

FIG. 5 is a side elevation view of the core mounting ring member.

In FIG. 1, assembly 2 in the present embodiment comprises a steel circular cylindrical drive shaft 4 having a central axially extending bore 6. Bore 6 receives pressurized air from source 8 via line 10. Source 8 includes a pressure regulator (not shown) for setting the air pressure on line 10 from zero to 100 LB of air pressure, for example. The upper pressure limit may be higher or lower as desired according to a given implementation. The shaft 4 has a linear array of identical radially extending bores 12 in fluid communication with central bore 6. The bores 12 are in communication with the shaft 4 peripheral surface 14.

Rotationally mounted on surface 14 is an axial array of identical core mount ring members 16. The ring members 16 are captured on the shaft 4 by steel ring end collars 18, 20. The collars 18, 20 may be bolted, screwed or otherwise fastened to the shaft 4 with retaining rings (not shown) or other clamping devices. The ring members 16 each can rotate independently of the other ring members and end collars 18,20 about the shaft 4 axis 22. The shaft 4 is rotationally driven by a conventional drive system (not shown).

A representative ring member 16 will now be described in connection with FIGS. 2–5. In FIG. 2, ring member 16 comprises an outer preferably steel ring 24 and an inner preferably bronze ring 26. The outer ring 24 is press fitted onto the inner ring 26. The outer ring 24 has an annular array of equally spaced radially extending identically dimensioned bores 28. The bores 28 are offset from the ring central axis 30. Alternating bores 28, 28' have axes 32, 32' offset on opposite sides of the axis 30 an equal distance d (FIG. 4) from the axis 30 as best seen in FIG. 5.

A preferably steel button 34 is in each outer ring 24 bore 28, 28'. The button 34 has a semi-spherical end face 36 protruding from the bore 28. The button 34 is captured in the bore 28 by a radially inwardly directed swaged lip 38. The button 34 has an annular groove 40 in which is an O-ring 42. The bottom surface 44 of the button 34 is flat. A compression coil spring 46 is in bore 28 and urges the button radially outwardly from the shaft axis 22 (FIG. 1) at surface 44. The outer rings 24, FIG. 2, have bores 25 which serve to lighten the ring members 16 and have no operational function.

Inner ring 26 is radially inwardly of outer ring 24. The spring 46 abuts the inner ring 26 outer peripheral surface. The inner ring 26 has an inner annular groove 48, FIG. 3. A plurality of outwardly extending radial bores 50 are in ring 26 in communication with the groove 48. The bores 50 provide fluid communication between groove 48 and each of the bores 28, 28'. The grooves 48 are each aligned radially with a corresponding bore 12 in the shaft 4, FIG. 1.

Regulated settable pressure value pressurized air from source 8 is applied to the bore 6 in the shaft 4, FIG. 1, and is also applied to each ring member 16 groove 48 and bores 50. This pressurized air is then applied against the bottom surface 44 of each button of the ring member 16 urging that button radially outwardly in cooperation with the spring 46 for gripping a core or core portion mounted thereon.

In FIG. 3, each inner ring 26 has a pair of identical annular grooves 52 and 54 on opposite sides of the groove 48 in the inner ring inner surface. A radially extending aperture 56 through the inner ring 26 fluid couples the groove 52 to each bore 28. A similar radially extending aperture (not shown) fluid couples each bore 28' to groove 54.

The inner surface of the outer ring 24 has an axially extending aperture 58 which mates with and is aligned with a radially extending aperture 60 in the inner ring 26 forming an L-shaped air passageway. Aperture 60 is in fluid communication with groove 54. The resulting L-shaped passageway provides fluid communication between the bore 28 and groove 54. In similar fashion, the bores 28' are fluid coupled to groove 52 by an identical L-shaped passageway. In this way, all bores 28, 28' are fluid coupled to both of the grooves 52 and 54. Any pressurized air supplied to bores 28, 28' from groove 48 is thus also supplied to grooves 52 and 54 at the same time.

A quad O-ring 62 is in groove 52 and an identical quad O-ring 64 is in groove 54. These O-rings have four corners and are somewhat square in cross section with a concave region between each set of opposite corners on each side. These O-rings are commercially available and are known as quad O-rings due to their quadrangle shape. The quad O-rings are impregnated with chlorine to provide enhanced reduced friction in a known manner. These O-rings fit closely within each corresponding groove, but due to their concave surfaces provide some spacing to the side walls of the corresponding grooves which are preferably square in cross section. The O-rings 62 and 64 and corresponding grooves 52 and 54, respectively, are dimensioned so that the O-rings 62 and 64 are substantially flush with the radially inner surface 66 of the inner ring 26. That inner surface 66 slides on the outer peripheral surface 14 of the drive shaft 4. Therefore, the O-rings 62 and 64 also abut the shaft 4 outer surface. The chlorinated quad O-rings have a minimum of friction engagement with the shaft 4 outer surface due to the chlorine and thus readily slide over the drive shaft when the shaft rotates relative to the ring members 16 in the absence of pressurized air.

In operation, cores (not shown) for receiving tape strips, paper strips, cord or other elongated elements to be wound about the cores are mounted on the mounting ring members 16. The cores may be narrower or wider than the ring members 16. The cores are dimensioned to slide over and about the ring members 16 relative to the shaft axis 6. For example, there may be about a 0.030 inch clearance between the cores and the outer surface of the outer mounting ring 24. In so mounting the cores, the cores correspond to one or more ring members 16 or portions thereof and are concentrically mounted thereon. The buttons are staggered as shown in FIG. 5 to reduce the spacing between the buttons on adjacent ring members to accommodate cores of differing axial widths.

The buttons 34 are radially compressed inwardly so as to resiliently grip the corresponding core(s) or core portion mounted thereabout. The buttons uniformly grip and abut the corresponding core. The amount of initial gripping action when the core(s) is first mounted is in accordance with the spring characteristics of the springs 46. The compressive load on each core by the springs is sufficient to hold the core during a winding action according to the winding tension imposed by the strips being wound. Different strips of material may impose different winding tensions on a core for a given winding speed or torque. These tensions vary according to the material being wound in a way that is known to those of ordinary skill in this art.

Assuming the material being wound requires a low tension during winding, the operation may require no or a minimum amount of pressurized air from source 8. The amount of air pressure is controlled by a pressure regulator (not shown) associated with the source 8. Assuming further, that during such winding, certain of the cores exhibit too little tension on the strips wound thereon, the regulator is adjusted to increase or first apply pressurized air to the shaft 4.

The pressurized air is applied uniformly to all of the central grooves 48 of each ring member via the corresponding bores 12 in the shaft 4. This pressurized air is then applied to the buttons 34 increasing the pressure on the buttons and thus on the cores. This action grips the cores with a more firmer gripping action to preclude slippage thus increasing the torque on the cores in response to the rotating drive shaft. The cores exhibiting too little tension thus are provided increased torque which increases the tension. Since the remaining cores are being wound at an appropriate tension, they will continue to maintain that tension.

At the same time, however, the pressurized air is also applied to the quad O-rings 62 and 64. This pressure on the O-rings tends to cause the O-rings to seal further in their respective grooves and reduce pressurized air leakage bypassing these O-rings. This action seals the region on either side of the central groove 48 to preclude air leakage at the interface of the ring member 16 with the drive shaft outer surface. This action also increases the pressure further on the buttons increasing their gripping action on the cores further. Also, the pressure on the quad O-rings 62 and 64 presses the O-rings radially inwardly against the drive shaft peripheral surface 14 providing enhanced sealing action against the drive shaft. This increased pressure of the O-rings on the drive shaft also increases the friction between the drive shaft and the individual mounting ring members, driving them faster, i.e., reducing slippage between the mounting ring members 16 and the drive shaft. This increases the torque on the ring members further and thus on the cores as well. Because a core may be on one or more or a portion of one or more ring members and the associated buttons, providing uniform tension on the different cores would otherwise be difficult.

In the case of too much tension, the friction slip action between each mounting member 16 and the drive shaft is such that those cores exhibiting higher than average winding tension will tend to slip more relative to the drive shaft than those cores exhibiting a lower tension. This is since the friction engagement of the quad O-rings between all of the ring members and drive shaft is the same due to the uniformity of the pressure on each O-ring. Thus those cores with higher winding tension will tend to slip more relative to the drive shaft than those cores with a lower tension. By increasing the air pressure such slippage is minimized and made more uniform among the different cores.

Therefore, the arrangement described tends to equalize the tension on a plurality of cores being wound side by side on the adjacent mounting ring members all being driven by a common drive shaft.

If the type of material being wound requires increased winding torque, the pressure is adjusted upwards an amount accordingly so that the tension is at the desired level. That level is one where the windings are not so loose so as to form a poorly wound core or too tight such that the strip material being wound breaks. The desired pressured is determined empirically for each winding configuration.

The staggered arrangement of the buttons as shown in FIG. 5 also contributes to providing a more uniform tension on the cores during winding by gripping the cores regardless the core widths and location on the various mounting ring members. This staggering tends to grip cores of more widely diversified width dimensions by spacing the buttons closer together on adjacent mounting members.

It will occur to one of ordinary skill in this art that various modifications may be made to the disclosed embodiments without departing from the spirit and scope of the invention. The disclosed embodiments are for illustration and not limitation. The invention is defined by the appended claims.

For example, the buttons may take the form of other conventional or non-conventional plugs as employed in the prior art as disclosed in the patents noted in the introductory portion. While quad O-rings are preferred, O-rings of other shapes, materials and configurations may also be used according to a given implementation.

What is claimed is:

1. Apparatus for securing a plurality of cylindrical winding cores on a winding drive shaft during winding of elongated elements at differential winding rates on corresponding cores comprising:

a hollow cylindrical mounting ring member defining a rotation axis and for releasably mounting a first core thereon and adapted to be rotationally slidably secured on a received drive shaft at a mounting member drive shaft interface surface, the mounting member having a plurality of bores extending radially relative to the axis;

a button radially movable in each said bores;

spring means for radially outwardly displacing the button in each said bores for gripping the first core mounted thereon; and a pliable distortable gripping element at said interface surface and responsive to applied radial forces created by a pressurized fluid applied directly to the gripping element to cause the gripping element to distort and to frictionally couple the mounting member to the drive shaft such that the mounting member is rotatably driven by the drive shaft at a speed and torque corresponding to the magnitude of the friction value.

2. The apparatus of claim 1 wherein the cylindrical core mounting member has a first annular groove in said interface surface, said gripping element comprising a first resilient pliable material located in the first groove and which gripping element in response to said applied forces grips and couples the drive shaft to the mounting member while simultaneously fluid sealing the interface between the mounting ring member and the drive shaft.

3. The apparatus of claim 2 including fluid passages in said mounting member for receiving said applied pressurized fluid and for applying said received pressurized fluid to said bores for radial outward displacement of the corresponding buttons and for said applying said pressurized fluid to said first gripping element for applying radial inward forces to the gripping element for friction and sealing engagement with the drive shaft.

4. The apparatus of claim 3 wherein the fluid passages comprises a second annular groove in said interface surface and at least one aperture in said mounting member and in fluid communication with and corresponding to each bore and said second annular groove, said second annular groove for fluid coupling said bores to a source of said pressurized fluid through said at least one aperture.

5. The apparatus of claim 4 including a third annular groove in said mounting member interface surface in fluid communication with said at least one aperture for receiving said applied pressurized fluid, said third groove including a second resilient pliable gripping element which is responsive to pressurized fluid directly applied there to for creating radial forces thereon for gripping and coupling the drive shaft to the mounting member.

6. The apparatus of claim 4 wherein the fluid passage means comprises further passages fluid coupling each of the bores to the first and third grooves.

7. The apparatus of claim 2 wherein the gripping element is adapted to frictionally engage the mounting member and the drive shaft at corresponding settable friction values, the values of the friction set corresponding to the pressure value of the pressurized fluid.

8. The apparatus of claim 1 wherein the gripping element comprises an elastomeric ring normally having a given friction property, said gripping element being treated to reduce the value of said friction property and while fluid sealing said drive shaft to said mounting member.

9. The apparatus of claim 1 wherein the friction coupling of the mounting member to the drive shaft is such that there is rotational slippage between the mounting member and drive shaft.

10. The apparatus of claim 1 including passages so positioned and responsive to an applied pressurized fluid to create the applied forces so that the gripping element is forced radially inwardly toward the received drive shaft.

11. The apparatus of claim 1 including means for setting the value of said applied forces.

12. Apparatus for securing a plurality of cylindrical winding cores on a winding drive shaft for providing differential winding rates during winding of elongated elements onto corresponding cores comprising:

a drive shaft, said shaft including means for receiving an applied pressurized fluid having a settable pressure value;

a hollow cylindrical core mounting ring member rotationally and releaseably mounted on the shaft at a member drive shaft interface surface, the member for releasably mounting a first core thereon, the mounting member having a plurality of radially extending bores;

a button radially movable in each said bores;

spring means for radially outwardly displacing the button in each said bores of the mounting member for resiliently gripping the first core mounted thereon; and at least one pliable distortable gripping element at said interface surface and responsive to a pressurized fluid applied directly to the gripping element, the pressure being at a value for settably frictionally causing the gripping member to couple the mounting member to the drive shaft so the mounting member is rotatably driven at a selected relative torque and speed corresponding to the set friction value.

13. The apparatus of claim 12 including means for applying said selected applied pressurized fluid to said bores for urging said at least one gripping element radially inwardly.

14. The apparatus of claim 13 including fluid passage means in said mounting member for receiving said pressurized fluid applied thereto and for applying said received pressurized fluid to said bores for radial outward displacement of the button and for applying said pressurized fluid to said at least one gripping element for applying radially inward forces to the at least one gripping element.

15. The apparatus of claim 13 wherein the fluid passage means comprises a second annular groove in said interface surface and at least one aperture in said mounting member and in fluid communication with and corresponding to each bore and said second annular groove, said second annular groove for fluid coupling said bores to a source of said pressurized fluid through said at least one aperture.

16. The apparatus of claim 15 including a third annular groove in said mounting member interface surface in fluid communication with said at least one aperture for receiving said applied pressurized fluid, said second groove being located between the first and third grooves, said third groove including a second resilient pliable gripping element which is responsive to said pressurized fluid applied directly thereto for creating forces for radially inwardly gripping and coupling the drive shaft to the mounting member in cooperation with the at least one gripping member.

17. The apparatus of claim 12 wherein the cylindrical core mounting ring member has a first annular groove in said interface surface, said at least one gripping element comprising a first resilient pliable material in the first groove and which element is responsive to said applied pressurized fluid for gripping and coupling the drive shaft to the mounting member.

18. The apparatus of claim 17 wherein the at least one gripping element comprises an elastomeric ring.

19. The apparatus of claim 17 wherein the at least one gripping element is adapted to frictionally engage the mounting element and drive shaft at corresponding settable friction values, the values of the friction corresponding to the pressure value of the pressurized fluid.

20. Apparatus for securing a plurality of cylindrical winding cores on a winding drive shaft during winding of elongated elements at differential winding rates on corresponding cores comprising:

a hollow cylindrical core mounting ring member adapted to be rotationally slidably secured on said drive shaft at a member drive shaft interface surface in an interface region, said mounting member having an annular groove formed in said interface surface, said member having an annular array of radially extending bores each in fluid communication with said interface region and groove, the bores for receiving an applied pressurized fluid at said interface region, said applied pressurized fluid being concurrently applied to the groove;

a core gripping button radially movable in each said bores and for radially outward displacement in response to said applied pressurized fluid;

a spring coupled to each button in each bore for normally resiliently urging said button radially outwardly to engage a corresponding winding core mounted on said mounting member; and a resilient distortable annular friction member in said groove, said friction member being radially inwardly responsive to said pressurized fluid applied to the groove directly to the friction member for frictionally gripping the drive shaft to settably set the torque and speed of the mounting member relative to the drive shaft.

21. The apparatus of claim 20 including a plurality of said grooves and a like plurality of friction members for further axially sealing the interface region between said grooves while concurrently causing the friction members to grip the shaft, said bore being located between said grooves.

* * * * *